United States Patent [19]

Taylor

[11] Patent Number: 4,933,823

[45] Date of Patent: Jun. 12, 1990

[54] REFLECTOR MATERIAL FOR ARTIFICIAL LIGHT SOURCE

[75] Inventor: Alan Taylor, Martinsville, Va.

[73] Assignee: Martin Processing, Inc., Martinsville, Va.

[21] Appl. No.: 367,612

[22] Filed: Jun. 19, 1989

[51] Int. Cl.[5] ..... F21V 7/00

[52] U.S. Cl. ..... 362/341; 362/219; 362/260; 362/296; 350/642; 428/458

[58] Field of Search ..... 350/641, 642; 428/458; 362/219, 260, 296, 307, 341, 347

[56] References Cited

U.S. PATENT DOCUMENTS

| | | | |
|---|---|---|---|
| 2,103,538 | 12/1937 | Kolb . | |
| 4,101,698 | 7/1978 | Dunning et al. | 428/31 |
| 4,235,951 | 11/1980 | Swarovski | 428/40 |
| 4,340,646 | 7/1982 | Ohno et al. | 428/429 |
| 4,345,000 | 8/1982 | Kawazoe et al. | 428/458 |
| 4,457,587 | 7/1984 | Katayama et al. | 350/641 |
| 4,457,598 | 7/1984 | Shimabukuro et al. | 350/641 |
| 4,463,055 | 7/1984 | Hodges | 428/458 |
| 4,489,110 | 12/1984 | Bier | 427/250 |
| 4,571,361 | 2/1986 | Kawaguchi et al. | 428/458 |
| 4,642,741 | 2/1987 | Cohn | 362/347 |
| 4,645,714 | 2/1987 | Roche et al. | 428/458 |
| 4,666,263 | 5/1987 | Petcavich | 350/640 |

OTHER PUBLICATIONS

Sheldahl, Inc., Part Number Listing and General Specification, Sheldahl, Inc., Vacuum Metalized Materials Division, Northfield, Minn.

Bell Aerospace Systems Division, Document BMS 17.15, Bell Aerospace Systems Division, Boulder, Col., 2/1/73.

Hughes Standard HMS 2191, Hughes Aircraft Company, Dec. 22, 1982, Culver City, Calif.

*Primary Examiner*—Stephen F. Husar
*Assistant Examiner*—Alan Cariaso
*Attorney, Agent, or Firm*—Sheldon & Mak

[57] ABSTRACT

A dust-resistant mirrored surface reflector for use with a source of artificial light is provided. The reflector comprises (i) a planar transparent substrate (such as a sheet of glass or plastic), (ii) a reflective metal layer coated onto one side of the substrate, and (iii) a transparent, conductive material layer (such as indium oxide, tin oxide, zinc oxide or indium-tin oxide) coated onto the other side of the substrate. The conductive material layer has an electrical resistance less than about $10^{12}$ ohms per square.

19 Claims, 1 Drawing Sheet

REFLECTOR MATERIAL FOR ARTIFICIAL LIGHT SOURCE

FIELD OF THE INVENTION

This invention relates generally to the field of reflectors useful in the reflection of artificial light, and more specifically to the field of artificial light reflectors having mirrored surfaces.

BACKGROUND

Reflectors are commonly used with sources of artificial light to reflect rays of light towards a target. Such reflectors are common, for example, as lamp shades, fluorescent light housings, automobile headlight reflectors, etc.

Most such reflectors in use today are merely shiny metal or diffuse white painted surfaces. However, there are many applications where more efficient reflectors are required, such as for use in automobile headlight reflectors. Reflectors having a mirrored surface, that is a surface comprising a glass or plastic substrate which has been coated with a highly reflective metal layer, are increasingly used in high efficiency artificial light reflectors.

There is a problem, however, in the use of such mirrored surfaces in reflectors for artificial light. This problem stems from the fact that the outer glass or plastic surface tends to attract dust from the air. This dust decreases the efficiency of the reflector and detracts from the reflector's appearance. Also, the dust attracted to the mirrored surface is commonly difficult to remove and the attempt to remove such dust commonly results in a more rapid build-up of new dust when the reflector is placed back in service. The propensity of mirrored surface reflectors to attract and retain dust is especially a problem when such reflectors are desired for use in dusty or otherwise unclean environments such as in factories, building sites, etc.

There is therefore a need for an inexpensive and efficient mirrored surface reflector which does not attract and retain dust.

SUMMARY

The mirrored surface reflector combination of the invention satisfies this need. The invention is a combination comprising (a) a source of artificial light, (b) a reflector support having a front surface and a back surface, (c) structural means for maintaining the reflector support in spatial relationship to the source of artificial light such that the front surface of the reflector support faces the source of artificial light; and (d) reflective composite material disposed on the front surface of the reflector support, the reflective composite material comprising (i) a planar, transparent substrate having first and second planar surfaces; (ii) a reflective metal layer disposed on the first planar surface of the substrate; and (iii) a transparent, conductive material layer disposed on the second surface of the substrate, the transparent conductive layer having an electrical resistance less than about $10^{12}$ ohms per square.

In one preferred embodiment, the planar substrate is a sheet of transparent polymer such as polyester, polycarbonate or polymethylmethacrylate, the reflective metal layer is aluminum or silver, and the transparent conductive material layer is indium oxide, tin oxide, zinc oxide or indium-tin oxide.

The invention is also a method of reflecting artificial light comprising the step of reflecting rays of artificial light with a reflective surface which is comprised of (a) a planar, transparent substrate having first and second planar surfaces, (b) a reflective metal layer disposed on the first planar surface of the substrate, and (c) a transparent, conductive material layer disposed on the second surface of the substrate, the transparent conductive material layer having an electrical resistance less than about $10^{12}$ ohms per square.

DRAWINGS

These and other features, aspects and advantages of the present invention will become understood with reference to the following description, appended claims and accompanying drawings where:

DESCRIPTION

Figure 1:
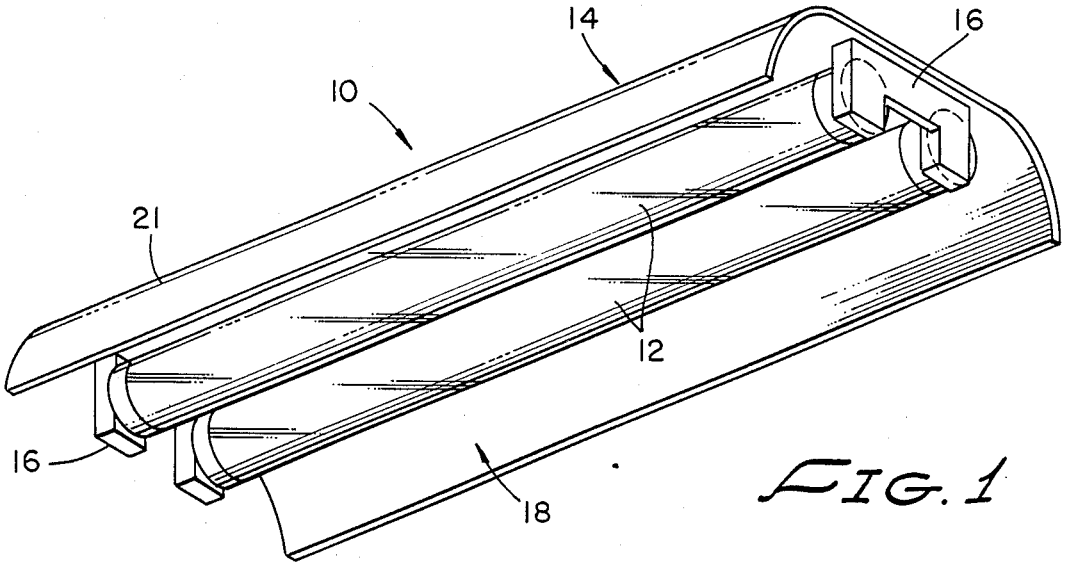
FIG. 1 is a perspective view of a combination having features of the invention.
Figure 2:
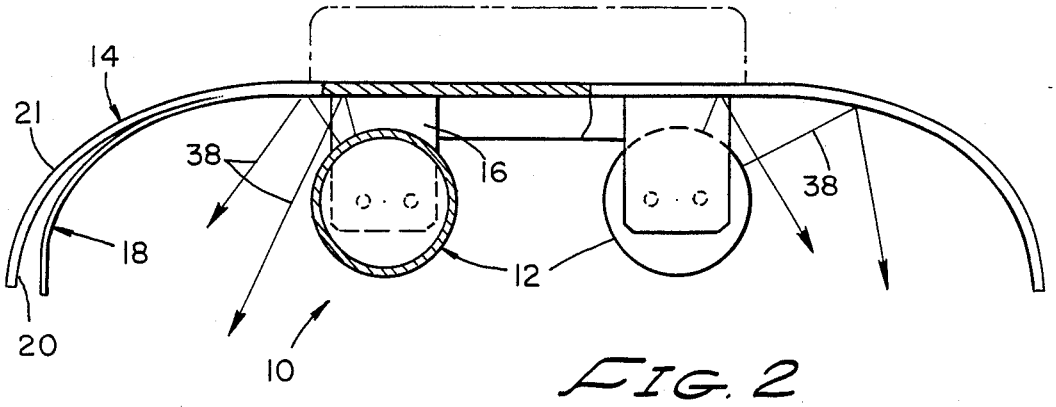
FIG. 2 is an end view of the combination shown in FIG. 1.
Figure 3:
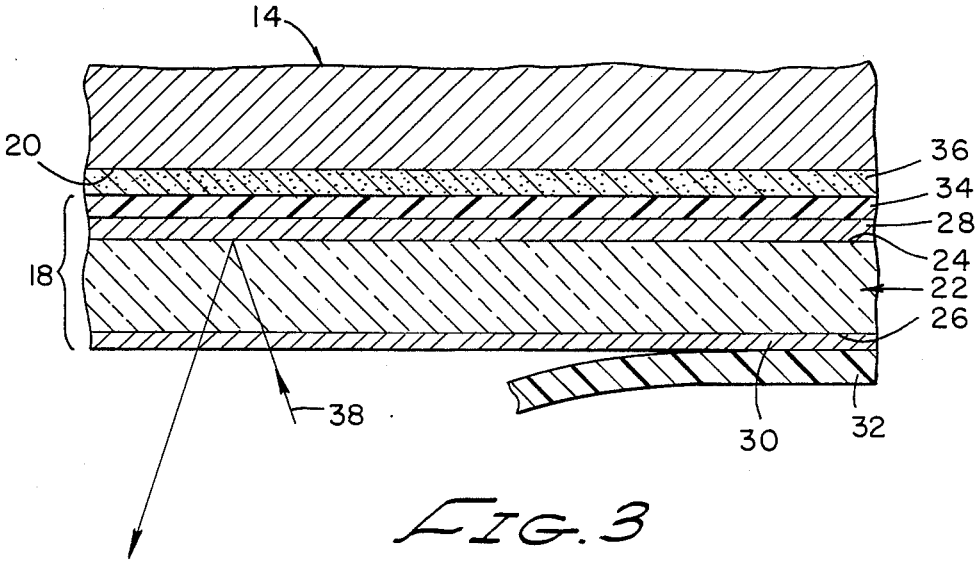
FIG. 3 is a cross-sectional view of the reflector element of the combination shown in FIGS. 1 and 2 having features of the invention.

The invention is a combination 10 comprising (i) a source of artificial light 12, (ii) a reflector support 14, (iii) structural means 16 for maintaining the reflector support 14 in spatial relationship to the source of artificial light 12, and (iv) a reflective composite material 18 disposed on the surface of the reflector support 14 facing the source of artificial light 12.

The source of artificial light 12 can be any of the commonly known sources of artificial light such as incandescent light bulbs, fluorescent lights, vapor lamps, light emitting diodes, etc.

The reflector support 14 has a front surface 20 and a back surface 21. The reflector support 14 can be any suitable material capable of retaining the reflective composite material 18 in an appropriate spatial relationship with the source of artificial light 12. Shaped metal sheets can be used, as can plastics, cardboards, woods and other similar materials having sufficient rigidity, lightness of weight and heat resistance. Preferably, the surface of the reflector support 14 facing the source of artificial light 12 is smooth to facilitate the attachment of the reflective composite material 18.

The structural means 16 for maintaining the reflector support 14 in spatial relationship with the source of artificial light 12 can be any suitable structure capable of retaining the reflector support 14 at an appropriate distance from, and orientation with respect to, the source of artificial light 12. Such structural means may be combined with the reflector support 14 to form an integral unit which at once retains the source of artificial light 12 and the reflector support 14.

The reflective composite material 18 is comprised of (i) a planar, transparent substrate 22 having a first planar surface 24 and a second planar surface 26, (ii) a reflective metal layer 28 disposed on the first planar surface 24 of the substrate 22 and (iii) a transparent, electrically conductive material layer 30 disposed on the second surface 26 of the substrate 22.

The substrate 22 can be any suitable material which has sufficient structural properties for supporting the metal layer 28 and the conductive material layer 30, and which is suitably transparent to visible light. Various transparent glasses and other ceramic materials can be used. For ease of manufacture and for ease of installation to curved or irregular reflector supports, the substrate 22 material is a polymer film such as polyester, polycarbonate or polymethylmethacrylate. A preferred material is PET polyester because it is readily available as a low cost film, is highly transparent, has a highly smooth, specular surface, is resistant to chemical and other environmental attack, and is available in suitable lengths, widths and thicknesses.

The substrate 22 can be of any suitable thickness so long as the appropriate structural and transparency characteristics are maintained. Typical thicknesses are between about 0.0003 and about 0.03 inches. Preferably, the substrate 22 thickness is between about 0.0005 and about 0.003 inches because these thicknesses are sufficient for processing without wrinkling or other damage to the film or coating. Thicker films are unnecessarily heavy and expensive unless it is desired to manufacture a reflector without a support.

The reflective metal layer 28 can be a layer of any reflective metal. Aluminum and silver are preferred metals because they are highly reflective, have a neutral reflected color, are easily deposited, and are relatively inexpensive. Silver is the most preferred metal because it has a significantly higher reflectance than aluminum, which produces a more efficient reflector, justifying its higher cost.

The reflective metal layer 28 can be of any thickness so long as it reflects the desired amount of visible light. Where the metal is silver, the thickness of the reflective metal layer 28 is typically between about one and about twenty microinches. Reflective metal layers 28 having thicknesses between about two and about twenty microinches can be used in the invention. Preferably, the thickness of the reflective metal layer 28 is between about two and about twelve microinches because a silver coating in this thickness range has essentially the same reflectance as bulk silver, yet does not have the extra cost or bulk of a thicker coating, and is thick enough to be environmentally stable.

The transparent conductive material layer 30 can be any of a variety of materials having suitable transparency and conductivity characteristics. Suitable materials for the transparent conductive material layer 30 include metal salts, ionic conductors and some organic polymers. Wide band-gap metal oxide semiconductors such as indium oxide, tin oxide, zinc oxide and indium-tin oxide can be used for the transparent conductive material layer 30. Indium oxide, tin oxide and indium-tin oxide are the preferred materials for the transparent conductive material layer because they can be conveniently deposited onto polymer films, with well-controlled optical and electrical properties, by deposition processes such as reactive sputtering.

Typically, the thickness of the transparent conductive material layer 30 is between about 0.1 and about four microinches. Preferably the thickness of the transparent conductive material layer 30 is between about 0.1 and one microinches. Thicker layers are usually unnecessary. Also, thicker layers may absorb enough light in a specific frequency range to give the reflected light a non-white color.

It has been found that the resistivity of the transparent conductive material layer 30 should be less than about $10^{12}$ ohms per square to yield satisfactory results. Preferably, for minimum dust buildup, the resistivity of the transparent conductive material layer 30 should be less than about $10^{9}$ ohms per square.

Typically, the substrate 22 and the transparent conductive material layer 30 together transmit greater than about 80% of visible light. Preferably, the substrate 22 and the transparent conductive material layer 30 transmit together greater than about 90% of visible light.

The reflective composite material 18 typically reflects greater than about 80% of incident visible light. Preferably, the reflective composite material 18 reflects greater than about 85% of incident visible light.

The reflective metal layer 28 and the transparent conductive material layer 30 can be applied to the surfaces of the substrate 22 by any of the coating methods commonly known in the art, including evaporative deposition and reactive sputtering.

Other layers can also be used in the reflective composite material 18. For instance, a first protective film 32 can be put on the exterior of the transparent conductive material layer 30 to minimize damage to the transparent composite material layer 30 prior to installation. Such first protective film 32 is then removed prior to operation. Also, a second protective coating 34 can be applied to the surface of the reflective metal layer 28 opposite the substrate 22 to protect the reflective metal layer 28 from damage prior to the installation of the reflective composite material 18 to the reflector support 14.

The reflective composite material 18 is disposed against and attached to the front surface of the reflector support 14 such that the transparent conductive material layer 30 faces away from the reflector support 14 and towards the source of artificial light 12. The reflective composite material 18 can be attached to the reflector support 14 with a suitable adhesive 36.

Where the substrate 22 is a flexible material such as a sheet of polymer film, the reflective composite material 18 is readily shaped to conform to the surface of the reflector support 14. Where the substrate 22 material is relatively rigid, such as when the substrate 22 is made from a glass, it is generally easier to pre-form the substrate 22 to conform to the surface of the reflector support 14 (and only thereafter coat the substrate 22 with the reflective metal layer 28 and the transparent conductive material layer 30).

In operation, rays of light 38 from the source of artificial light 12 radiate to the front surface of the reflector support where they first encounter the transparent conductive material layer 30 of the reflective composite material 18. A small portion of the rays are reflected off of the transparent conductive material 30 layer towards the target area. The remainder of the rays 38 pass through the transparent conductive material layer 30 and contact the transparent substrate 22. The rays 38 then pass through the transparent substrate 22 and are reflected by the reflective metal layer 28. After being reflected by the reflective metal layer 28, the rays 38 pass back through the substrate 22, then back through the transparent conductive material layer 30 and radiate away from the transparent conductive material layer 30 towards the target area.

The combination of the invention 10 provides a high degree of reflectance of artificial light, but, unlike devices of the prior art, does not attract and retain dust from the environment.

The combination of the invention 10 has the additional advantage over most conventional reflecting combinations in that the combination of the invention 10 inhibits the degradation of the polymer substrate 22 and the bond between the polymer film substrate 22 and the reflective metal layer 28. With prior art combinations, ultraviolet light which is produced in significant quantities by many sources of artificial light (e.g., fluorescent lights) degrades the polymer substrate 22 and is detrimental to the strength of the substrate-metallic layer bond. Most wide band-gap metal oxide semiconductors (and some organic material such as acrylics) which are used in typical embodiments of the invention 10 absorb ultraviolet light. Therefore, such embodiments of the invention 10 reduce the ultraviolet light degradation of the substrate 22 and substrate-metal bond by absorbing some of the ultraviolet light in the transparent conductive material layer 30.

EXAMPLES

Example 1

A roll of 0.002 inch thick PET polyester film was coated by magnetron sputtering with a silver coating which had an optical density of approximately 3.0 and a surface resistance of approximately 0.4 ohms per square. The film was then attached to an aluminum support sheet with a pressure sensitive adhesive. The resulting construction was then formed into the shape of a fluorescent light reflector and installed in a conventional ceiling fixture. The construction was operated as a reflector for a source of fluorescent light for several days. After that time period, it was observed that various dust patterns were visible on the construction. Cloud-like patterns, "starbursts," "lighting bolts," large particle groups, clumps and lines of dust were observed on the construction. The dust was difficult to remove from the construction, and attempts to wipe the dust from the construction merely caused the dust to smear.

Example 2

A construction identical to the construction described in Example 1 was prepared, except that the side of the polyester film opposite the metalized side was coated (prior to metalization) with indium oxide by reactive magnetron sputtering. The thickness of the indium oxide coating was between about 0.2 and about 0.4 microinches thick. Its surface resistance was between about $10^3$ and $10^9$ ohms per square.

This second construction (having the layer of transparent conductive material) was no less transparent than the construction of Example 1, as measured by conventional photometric techniques.

The construction having the transparent conductive layer was formed into the shape of a fluorescent light fixture in the same way as was the construction of Example 1. It was then installed in a ceiling fixture at the same location and during the same time period as the construction described in Example 1. At the end of the time period, when the construction described in Example 1 was covered with difficult-to-remove dust, the construction having the transparent conductive layer had little dust on its surface. What dust there was wiped away easily and completely with a clean cloth.

Although the present invention has been described in considerable detail with reference to certain preferred versions, other versions are possible. Therefore, the spirit and scope of the appended claims should not necessarily be limited to the description of the preferred versions contained herein.

I claim:

1. The combination comprising:

(a) a source of artificial light;

(b) a reflector support having a front surface and a back surface;

(c) structural means for maintaining the reflector support in spatial relationship to the source of artificial light such that the front surface of the reflector support faces the source of artificial light; and (d) a reflective composite material disposed on the front surface of the reflector support, the reflective composite material comprising:

(i) a planar, transparent substrate having first and second planar surfaces;

(ii) a reflective metal layer disposed on the first planar surface of the substrate; and (iii) a transparent, conductive material layer disposed on the second surface of the substrate, the transparent conductive layer having an electrical resistance less than about $10^{12}$ ohms per square;

the reflective composite material being disposed on the front surface of the reflector support such that the transparent conductive layer faces away from the reflector support and towards the source of artificial light.

2. The combination of claim 1 wherein the transparent conductive layer has an electrical resistance less than about $10^9$ ohms per square.

3. The combination of claim 1 wherein the source of artificial light is one or more fluorescent bulbs.

4. The combination of claim 1 wherein the substrate is a glass.

5. The combination of claim 1 wherein the substrate is a polymer.

6. The combination of claim 1 wherein the substrate is selected from the group of materials consisting of polyesters, polycarbonates and polymethylmethacrylates.

7. The combination of claim 1 wherein the substrate is PET polyester.

8. The combination of claim 1 wherein the reflective metal layer consists essentially of aluminum.

9. The combination of claim 1 wherein the reflective metal layer consists essentially of silver.

10. The combination of claim 1 wherein the reflective metal layer is between about two and about twelve microinches thick.

11. The combination of claim 1 wherein the transparent conductive material layer is comprised of a wide band-gap metal oxide semiconductor.

12. The combination of claim 1 wherein the transparent conductive material layer is chosen from the group of materials consisting of indium oxide, tin oxide, zinc oxide and indium-tin oxide.

13. The combination of claim 1 wherein the transparent conductive material layer is between about 0.1 and about one microinches thick.

14. The combination of claim 1 wherein the substrate and transparent conductive material layer together transmit greater than about 85% of visible light.

15. The combination of claim 1 wherein the reflective composite material reflects greater than about 90% of visible light.

16. The combination of claim 14 wherein the reflective composite material reflects greater than about 90% of visible light.

17. The combination comprising:

(a) a source of artificial light;

(b) a reflector support having a front surface and a back surface;

(c) structural means for maintaining the reflector support in spatial relationship to the source of artificial light such that the front surface of the reflector support faces the source of artificial light; and (d) a reflective composite material disposed on the front surface of the reflector support, the reflective composite material comprising:

(i) a planar, transparent polymer sheet substrate having first and second planar surfaces and being between about 0.0005 and about 0.003 inches thick;

(ii) a reflective layer of silver having a thickness between about two and about twelve microinches and disposed on the first planar surface of the substrate;

(iii) a transparent, conductive material layer selected from the group of materials consisting of indium oxide, tin oxide, zinc oxide and indium-tin oxide, such transparent conductive material being disposed on the second surface of the substrate and having a thickness between about 0.1 and about one microinches thick;

the reflective composite material being disposed on the front surface of the reflective support such that the transparent conductive layer faces away from the reflector support and towards the source of artificial light.

18. A method of reflecting artificial light comprising the step of reflecting rays of article light with a reflective surface which is comprised of:

(a) a planar, transparent substrate having first and second planar surfaces;

(b) a reflective metal layer disposed on the first planar surface of the substrate; and (c) a transparent, conductive material layer disposed on the second surface of the substrate, the transparent conductive material layer having an electrical resistance less than about $10^{12}$ ohms per square; the reflective surface being disposed relevant to the rays of artificial light such that the rays of artificial light first strike the transparent conductive material layer, pass through the transparent conductive layer and the transparent substrate and are reflected by the reflective metal layer.

19. The method of claim 18 wherein the transparent conductive material layer has an electrical resistance less than about $10^9$ ohms per square.

* * * * *